United States Patent [19]

Volkmann

[11] Patent Number: 4,794,975

[45] Date of Patent: Jan. 3, 1989

[54] ANTI-SHIFT INSERT STRUCTURE FOR MATCHING COMPONENTS

[76] Inventor: Adolf P. E. Volkmann, 425 NE. 80th Ave., Portland, Oreg. 97213

[21] Appl. No.: 90,049

[22] Filed: Aug. 27, 1987

Related U.S. Application Data

[63] Continuation-in-part of Ser. No. 891,667, Aug. 1, 1986, abandoned.

[51] Int. Cl.[4] ..... B22C 7/00; B22C 9/02

[52] U.S. Cl. ..... 164/29; 164/241; 164/243; 164/339; 164/364

[58] Field of Search ..... 164/29, 339, 341, 364, 164/239, 241, 243

[56] References Cited

U.S. PATENT DOCUMENTS 1,561,500 11/1925 Wood .
1,717,109 6/1929 Last .
3,241,199 3/1966 Rabinovich .
3,897,817 8/1975 Nieman ..... 164/364
4,632,171 12/1986 Almond ..... 164/364 X
4,662,426 5/1987 Scherer ..... 164/239 X

FOREIGN PATENT DOCUMENTS 1173618 7/1964 Fed. Rep. of Germany .
1183486 1/1959 France .

*Primary Examiner*—Nicholas P. Godici
*Assistant Examiner*—J. Reed Batten, Jr.
*Attorney, Agent, or Firm*—Eugene M. Eckelman

[57] ABSTRACT

Inserts with projections and recesses are provided for securement to mold components and also are arranged to make respective recesses and projections in impression material such as sand. These recesses and projections in the impression material are dimensioned and shaped to have a reverse interfitting engagement to accomplish anti-shift functions and are dimensioned and arranged to form spaces between facing impression portions for receiving loose impression material. This arrangement also forms an improved method of mounting anti-shift inserts.

7 Claims, 1 Drawing Sheet

FIG. 1
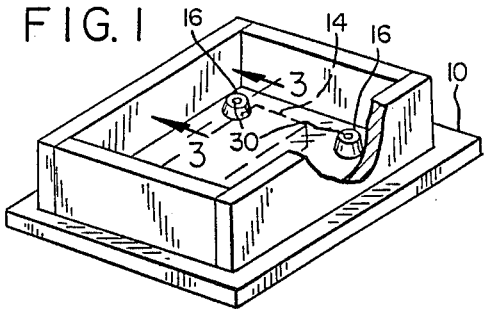
FIG. 2
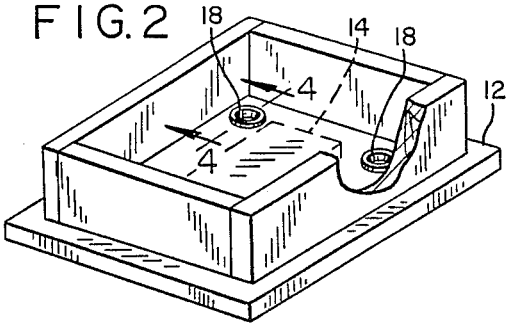
FIG. 3
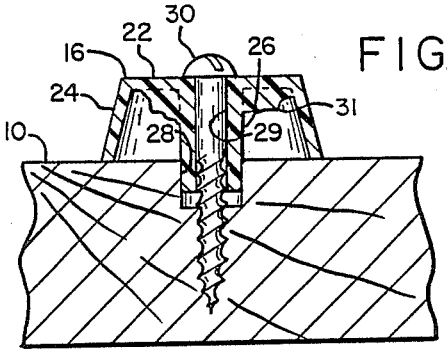
FIG. 4
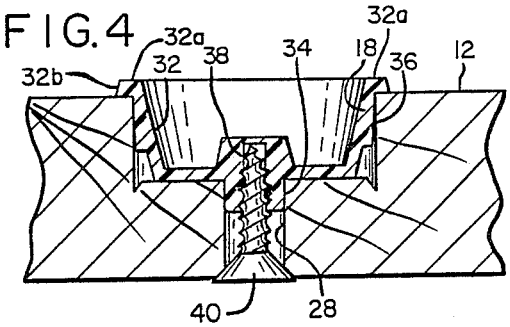
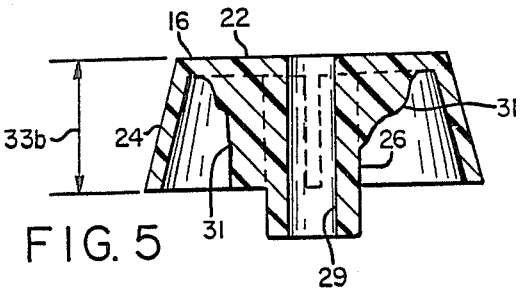
FIG. 5
FIG. 7
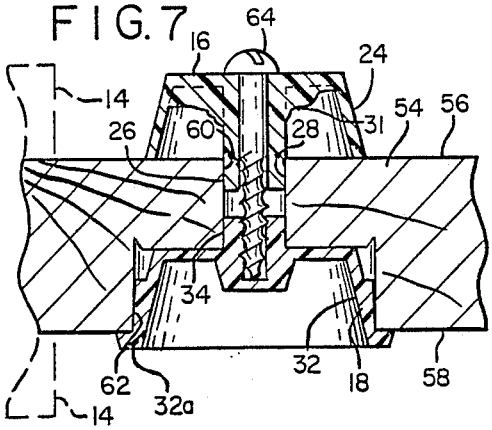
FIG. 6
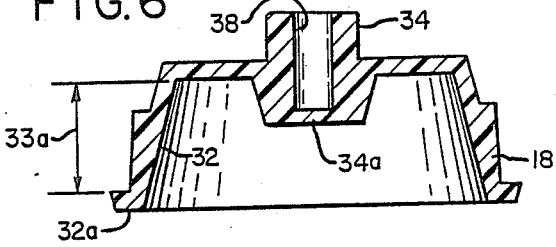
FIG. 9
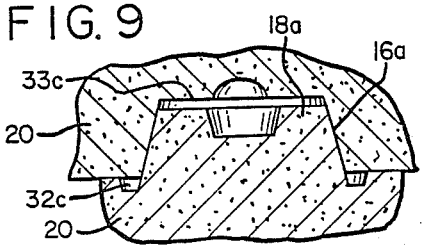
FIG. 8
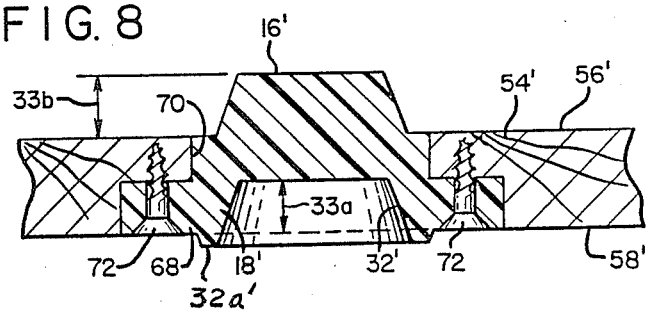

ANTI-SHIFT INSERT STRUCTURE FOR MATCHING COMPONENTS

REFERENCE TO PRIOR APPLICATIONS

This application is a continuation-in-part of application Ser. No. 891,667, filed Aug. 1, 1986 and now abandoned.

BACKGROUND OF THE INVENTION

This invention relates to new and useful improvements in anti-shift structures for matching components. Although the present invention is illustrated herein in conjunction with foundry castings, it is to be understood that it can be practiced with any work that utilizes matching faces of impression material or any two sides that have to match perfectly.

In producing castings in foundries, a pattern is used to make a mold in impression material associated with cope and drag boxes. After the removal of the pattern from each of the cope and drag boxes, the boxes are closed to pour the metal. To eliminate mis-matching while the boxes are being closed, or shifting then they are moved, before the metal is poured, anti-shift devices are necessary. Pattern makers have designed and used different types of anti-shift systems. One system utilizes guide fingers on the cope and drag boxes. Also, a popular anti-shift system utilizes disposable cores which are placed in recesses provided in the sand. A plurality of these cores are used for each casting operation and shifting is still not completely eliminated since the cores are loosely set in recesses in the impression material. Also, these cores are disposable and add extra cost as well as requiring extra handling time. Anti-shift systems are absolutely necessary in the air set method of producing castings.

SUMMARY OF THE INVENTION

According to the present invention and forming a primary objective thereof, an anti-shift structure for matching components is provided utilizing permanent insert means in mold apparatus which provide precise matching of mold parts whereby there will be no mismatching or shifting when the mold parts are closed or moved and precise castings can thus be produced.

Another object of the invention is to provide an anti-shift structure of the type described which is simple, accurate and easy to install in wood or similar boards and furthermore to provide such a structure which materially reduces the cost of castings and handling time.

A more particular object is to provide anti-shift structure designed specifically to replace the conventional method of using the undesirable disposable cores.

Still another object is to provide anti-shift structure having means forming collecting areas for loose impression material whereby to insure close fitting of matching components.

In accomplishing the above objectives, components to be used with impression material are equipped with first and second insert means arranged to make recessed and projecting contours respectively in the impression material. These insert means are dimensioned and shaped such that the recessed and projecting contours in the impression material have close tolerance male and female interfitting engagement when in reversed facing relation to provide anti-shifting connection to opposed portions of the impression material. The invention may be carried out in various ways of combining the first and second insert means with components used with the impression material, and some of the embodiments utilize a novel method of installing matching inserts that produce anti-shift male and female interfitting means. The first and second insert means are dimensioned to provide a space between opposing faces in the impression material for forming a collecting area for loose impression material to allow the matching components to always close. For this same purpose one of the insert means also has an extension thereon which forms a collection space around the insert for loose impression material.

The invention will be better understood and additional objects and advantages will become apparent from the following description taken in connection with the accompanying drawings.

BRIEF DESCRIPTION OF THE DRAWINGS

FIG. 1 is a perspective view of a mold component such as a cope and showing inserts of the invention installed thereon;

FIG. 2 is a perspective view of a second mold component such as the drag, the component of FIG. 2 being utilized in combination with the component of FIG. 1 to produce molds for foundry castings. This view shows matching inserts of the invention installed thereon;

FIG. 3 is an enlarged fragmentary sectional view taken on the line 3—3 of FIG. 1 and showing detailed structure of one of the inserts installed on a mold part;

FIG. 4 is an enlarged fragmentary sectional view taken on the line 4—4 of FIG. 2 and showing detailed structure of a cooperating insert installed on a matching mold part;

FIGS. 5 and 6 are enlarged sectional views taken through the matching inserts, the inserts being shown apart from any mold structure;

FIG. 7 is a sectional view showing the inserts of FIGS. 5 and 6 installed in a match board in a different arrangement from that of FIGS. 3 and 4;

FIG. 8 is a sectional view showing a second embodiment of the invention as installed in a mold part; and FIG. 9 is a sectional view taken through impression material which has been provided with male and female anti-shift contours by means of the present invention.

DETAILED DESCRIPTION OF PREFERRED EMBODIMENTS

With reference first to FIGS. 1 and 2, a cope 10 and drag 12 are shown which are utilized in a conventional manner to form castings in an air set or other system. That is, pattern parts 14 are placed in the drag 12, rammed with sand, and then rolled over on, a bottom board in the usual manner. The cope half of the pattern is then combined in a conventional manner with the drag and after formation of the cope half of the mold, the mold is ready for pouring. It is in the matching of the cope and drag that the present invention is concerned since as noted above, mis-matching often occurs when structures using the cope and drag boxes are closed or moved. That is, as noted above, previous structures use disposable core members to accomplish anti-shift functions, but it is found that such core members, being disposable, materially increase the over-all expense of the molding operation. It is also found that the conventional anti-shift means do not provide the precise anti-shift function desired with built-in tolerance and height clearance. As will now be described, it will be apparent that the present invention provides a precise anti-shift system for molds and at lower cost.

With particular reference to FIGS. 3 and 4, as well as to FIGS. 5 and 6, cooperating inserts 16 and 18 are provided which are arranged when mounted in mold parts to make recesses 16*a* and projections 18*a*, respectively, FIG. 9, in a proper fit in angled portions thereof and spacing in facing portions thereof in impression material 20 such as sand. The particular fit and spacing of these recesses and projections will be described in greater detail hereinafter. These cooperating inserts are associated with the matching faces of the mold parts and placed selectively so as to be out of the way of the patterns 14. These inserts are also provided in a number generally, at least three, which will provide effective anti-shift functions.

The insert 16 is of frustrum-conical shape, FIGS. 3 and 5, having a flat end surface 22, a wall or flange 24 tapered outwardly from the surface 22, and a central stem 26 which extends beyond the free end of the wall 24. This extended portion of the stem is arranged for insertion in a bore 28, FIG. 3, cut in the cope 10. Stem 26 has an axial bore 29 extending therethrough arranged to receive fastening means 30 such as a wood screw or the like for attaching insert 16 securely to the face of the cope. The insert has internal reinforcing ribs 31 extending radially between the stem 26 and wall 24. The free ends of these ribs are flush with the free end of wall 24. Such ribs may be four in number, as shown, spaced 90 degrees around the interior of the insert. More or less of these ribs may be provided, it being necessary that they be of a number and structure to provide sturdy reinforcement of the wall 22 and stem 26 with the wall 24. The free ends of the ribs, being flush with the free end of the wall 24, assist in providing a rigid form making member for impression material.

Insert 18 comprises a cup-shaped member, FIGS. 4 and 6, having an internal tapered area 32 of selected shape such as a 15° taper, to form a projection 18*a*, FIG. 9, in impression material 20, arranged to be received in a recess 16*a* made by insert 16. More particularly, the outer surface of wall 24 of insert 16 and inner surface 32 of insert 18 have identical inclines for providing a good sand fit as shown in FIG. 9. The internal diameter of recess 32, however, is slightly smaller than the outer diameter of insert 16 to allow for fitted engagement of the impressions 16*a* and 18*a*. Also, the interior dimension or depth 33*a*, FIG. 6, of insert 18 is less than the exterior dimension 33*b*, FIG. 5, of insert 16 whereby to provide a clearance area 33*c*, FIG. 9, in impressions made by the inserts in the impression material 20. Clearance area 33*c* is provided to form a space that can receive any impression material which may loosen from the mold. This prevents the possibility of the mold not closing due to the existence of loose impression material between facing portions of the mold.

Also, the open end of insert 18 has an extension 32*a* which projects beyond the surface of drag 12 and which is turned laterally outwardly at 32*b* or otherwise enlarged in cross section. As seen in FIG. 9, the extension 32*a* forms an annular recess 32*c* in the impression material for collecting loose sand that may be knocked loose, thus insuring that the matching components will always close when the components are fitted together in the arrangement shown in FIG. 9. Regardless of the relative position of the cope and drag, namely, regardless of the one that is on the bottom, there is a space to collect loose impression material, the space 32*c* collecting impression material when the parts are fitted in the FIG. 9 relationship and the space 33*c* collecting impression material when the parts are inverted from that of FIG. 9.

Insert 18 has a projecting stem 34 the outer diameter of which is the same as the outer diameter of stem 26 of insert 16. The drag 12 has a bore 28 which is the same diameter as bore 28 in the cope 10 and in fact, as will be seen, this bore is made simultaneously with the bore 28 in the cope 10. Insert 18 seats in a bore 36 cut into the drag 12 concentric with bore 28. In the installed position of the insert 18, its stem fits in bore 28. Insert 18 has a central screw accommodating projection 34*a* FIG. 6, extending a partial distance into area 32.

As stated, the bores 28 in the cope and drag are made at the same time, and this is accomplished by locating the face boards of the cope and drag in aligned face to face relation before the side boards are attached and then drilling the bore 28 completely through the face board of the drag and partly into the face board of the cope. The bore 28 in the drag 12 is used as a pilot hole to drill the larger bore 36 for the insert 18 and also the matching bores that are made in the cope and drag will locate the inserts for providing a precisely located anti-shift mold arrangement. The members 16 are illustrated herein as being secured to the cope and members 18 are illustrated as being secured to the drag but said members may be used with the mold parts in an opposite arrangement.

Stem 34 has an axial bore 38 terminating short of the inner end of projection 34*a*. This bore is arranged to receive fastening means 40 such as a self-tapping screw for secured attachment of insert 18 to the drag. The respective stems of the inserts fit tightly in their portions of the bores to provide good stability and accurate alignment of the inserts.

FIG. 7 shows a different application of the inserts. Such application utilizes a match board 54 having opposite faces 56 and 58 for supporting patterns 14 in the formation of the mold. In this structure, both inserts are mounted on the match board in back to back relation. Precise alignment of the inserts 16 and 18 is accomplished by providing a single bore 60 in the board 54 for receiving the ends of the stems 26 and 34, the bore 60 then comprising a pilot bore for forming the larger bore 62 for the insert 18. The board is of selected dimension such that the stems will not meet in the board when the two elements are held together by fastening means 64 passing through the element 16 and tapping itself into the insert 18. Bore 29 in insert 16 is slightly larger than bore 38 in insert 18 so the screw in this arrangement of inserts can engage and tap itself into insert 18. Cope and drag molds are prepared with the embodiment of FIG. 7 in a conventional manner using the surfaces 56 and 58 as support surfaces for the patterns 14. With the stems of the two inserts installed in the same bore, the inserts will be precisely mounted in matching relation to provide the accurate anti-shift matching of mold parts.

The structure of FIG. 8 is an embodiment similar to FIG. 7 except that matching insert portions 16' and 18' are molded in a one-piece structure. This one-piece anti-shift device is installed in a match board 54' with the tapered insert portion 16' projecting from the surface 56 and the matching insert portion 18' being recessed in the surface 58'. Flange means 68 are provided on the recessed side of the insert portions to hold the device in a bore 70 by fastening means 72 extending through the flange. In an arrangement similar to FIGS. 5 and 6, the insert portions 16' and 18' have a dimensional relationship in the areas 33*a* and 33*b* to provide a clearance similar to the clearance 33*c* in the impression material as illustrated in FIG. 9. That is, in the event loose sand gets between the impressions 16*a* and 18*a*, it will be deposited in the area 33*c* and will not cause mold parts to separate. The structure of FIG. 8 employs an extension 32*a*' on the portion 18 to catch loose impression material as in the first embodiment.

According to the invention, an accurate match of the cope and drag is provided at the time that the pattern is removed and the boxes closed again. This matching function also holds in the event that the boxes are moved. The structure is simplified and easy to install and also is inexpensive. More particularly, the insert means herein used are permanently installed in the mold parts and thus there will be no looseness which could possibly cause misalignment. Furthermore, the structure of the present inserts allows them to be precisely aligned whereby matching is precise in the impression material, and provision is made to catch loose impression material to insure that the matching components will close. Also, the present invention substantially reduces the costs of the molding operation both in handling time and in costs, as compared with the use of disposable cores, or other prior systems. Also, the present invention provides for easier installation of the anti-shift means and is novel also in that the inserts can be molded or otherwise manufactured and preformed so that all that is required to form an anti-shift in cope and drag is to attach the two members to the components of the mold. As noted above, such attachment can be accomplished to provide precise alignment and with built-in exact tolerances.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A method of providing anti-shift function to a mold having horizontal wall means with cooperating surfaces and arranged to receive deposits of impression material which are used to form castings comprising providing first and second separate insert means in mounted relation in a common bore made in opposite ones of said cooperating surfaces for making recessed and projecting contours in the impression material, and then engaging projecting and recessed contours made in the impression material by said first and second insert means, respectively, to provide said anti-shift function.

2. Anti-shift structure for a mold having wall means with cooperating surfaces and arranged to receive deposits of impression material which are used to form castings, said structure comprising:

first insert means arranged to be secured to one of the cooperating surfaces of the mold wall means in projecting relation relative to said surface, and second insert means separate from said first insert means arranged to be secured in inset relation in the other of the cooperating surfaces of the mold wall means, said first and second insert means having impression forming portions arranged to make recessed and projecting contours respectively in the impression material, said first insert means including a stem portion projecting in a direction opposite from its impression forming portion and arranged to project into a bore in the mold wall means, said second insert means also including a projecting stem portion projecting in a direction opposite from its impression forming portion and also arranged to project into the bore in the mold wall means from the opposite side of said first insert means for accomplishing precise alignment of said first and second insert means, and screw means securing said first and second insert means together in the mold wall means, said first and second insert means being dimensioned and shaped such that said recessed and projecting contours in the impression material are arranged to have a close tolerance interfitting engagement when in facing relation to provide anti-shifting connection to opposed portions of the impression material.

3. The anti-shift sturcture of claim 2 wherein said first insert means is frustrum-conical in shape and said second insert means is correspondingly tapered to provide said close tolerance interfitting engagement.

4. Anti-shift structure for a mold having wall means with cooperating surfaces and arranged to receive deposits of impression material which are used to form castings, said structure comprising:

first insert means arranged to be secured to one of the cooperating surfaces of the mold wall means in projecting relation relative to said surface, and second insert means separate from said first insert means arranged to be secured in inset relation in the other of the cooperating surfaces of the mold wall means, said first and second insert means having impression forming portions arranged to make recessed and projecting contours respectively in the impression material, said first and second insert means being dimensioned and shaped such that said recessed and projecting contours in the impression material are arranged to have a close tolerance interfitting engagement when in facing relation to provide anti-shifting connection to opposed portions of the impression material, said second insert means comprising a cup-shaped member having a flange with a free end and a lateral mounting rim on said free end which in use supports said second insert means at a proper depth in the mold wall means and also forms a space in impression material for receiving loose impression material.

5. The anti-shift structure of claim 4 wherein said first and second insert means are arranged to be secured to wall means of respective cope and drag mold parts.

6. The anti-shift structure of claim 4 wherein said first and second insert means are arranged to be secured in precise axial alignment on opposite sides of a match board, said second insert means being of less length than the thickness of the match board.

7. The anti-shift structure of claim 6 wherein said first and second insert means are arranged to be secured in said precise axial alignment on opposite sides of the match board by screw means in axial engagement with each of said first and second insert means.

* * * * *